US007950781B2

(12) United States Patent
Koseki

(10) Patent No.: US 7,950,781 B2
(45) Date of Patent: May 31, 2011

(54) INKJET HEAD CHIP, MANUFACTURING METHOD FOR INKJET HEAD CHIP, INKJET HEAD, AND INKJET RECORDING APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 166 days.

(21) Appl. No.: 12/319,378

(22) Filed: Jan. 7, 2009

(65) Prior Publication Data

US 2009/0185012 A1 Jul. 23, 2009

(30) Foreign Application Priority Data

Jan. 11, 2008 (JP) ..... 2008-003945

(51) Int. Cl.
*B41J 2/045* (2006.01)

(52) U.S. Cl. ..... 347/68

(58) Field of Classification Search ..... 347/71, 347/68, 70, 72; 400/124.14, 124.16; 310/311, 310/324, 327
See application file for complete search history.

(56) References Cited

U.S. PATENT DOCUMENTS

| | | | | |
|---|---|---|---|---|
| 5,619,235 | A | 4/1997 | Suzuki | 347/69 |
| 5,631,680 | A | 5/1997 | Sugahara | 347/69 |
| 2002/0003559 | A1 | 1/2002 | Harajiri | 347/68 |
| 2002/0005880 | A1 | 1/2002 | Ashe et al. | 347/68 |

FOREIGN PATENT DOCUMENTS

| | | |
|---|---|---|
| EP | 0676286 | 10/1995 |
| EP | 1167039 | 1/2002 |

*Primary Examiner* — K. Feggins
(74) *Attorney, Agent, or Firm* — Adams & Wilks

(57) ABSTRACT

An inkjet head chip has an actuator plate, discharge channels formed in the actuator plate for discharging ink, and non-discharge channels arranged alternately in parallel with the discharge channels and which are not configured to discharge ink. The actuator plate has a piezoelectric layer and a low-permittivity substrate layer. The piezoelectric layer is formed of a piezoelectric material and the low-permittivity substrate layer is formed of an insulating low-permittivity material having a lower permittivity than that of the piezoelectric material. One end of each discharge channel extends to an end surface of the actuator plate in a state in which the insulating low-permittivity material is exposed on a bottom surface thereof, and another end of each discharge channel does not extend to the end surface of the actuator plate. Each non-discharge channel extends over at least an entire length of the actuator plate in a state in which the insulating low-permittivity material is exposed on a bottom surface thereof. Piezoelectric elements formed of the piezoelectric material are disposed in the discharge and non-discharge channels and driven by a voltage signal for undergoing deformation to vary a volume in the discharge and non-discharge channels to thereby eject ink droplets from the discharge channels.

17 Claims, 9 Drawing Sheets

INKJET HEAD CHIP, MANUFACTURING METHOD FOR INKJET HEAD CHIP, INKJET HEAD, AND INKJET RECORDING APPARATUS

BACKGROUND OF THE INVENTION

1. Field of the Invention

The present invention relates to a piezoelectric type inkjet head chip for deforming a piezoelectric element through voltage application and boosting a channel internal pressure to discharge an ink droplet through a nozzle hole, a manufacturing method for an inkjet head chip, an inkjet head, and an inkjet recording apparatus.

2. Description of the Related Art

As to the above-mentioned piezoelectric type inkjet head chip, there has been conventionally known a structure including an ink chamber for containing ink, a plurality of piezoelectric elements deformable through voltage application, a plurality of channels partitioned with the piezoelectric elements and formed parallel to each other, and nozzle holes communicating with the channels for discharging an ink droplet toward a recording medium.

Specifically, the inkjet head chip includes an ink chamber plate including the ink chamber formed on one surface thereof, an actuator plate including the plurality of channels formed on one surface thereof, and a nozzle plate including a plurality of the nozzle holes formed in a row, in which another surface of the ink chamber plate and the one surface of the actuator plate are bonded to each other so that the ink chamber plate overlaps the actuator plate, and the nozzle plate is bonded to one end of the actuator plate in a channel longitudinal direction thereof. Ink introduction holes are formed in the ink chamber plate, and the ink chamber and the channels are communicated with each other through the ink introduction holes, whereby the ink contained in the ink chamber is supplied to the channels. According to the inkjet head chip with the structure as described above, a voltage is applied to the piezoelectric element for deformation, and a volume of the channel partitioned with the deformed piezoelectric element is contracted to boost a channel internal pressure, to thereby discharge the ink contained in the channel. Accordingly, the ink droplet can be sprayed onto the recording medium.

The above-mentioned inkjet head chip is classified into a shared wall type inkjet head chip in which discharge channels (channels communicating with the nozzle holes) are successively disposed side by side and an independent channel type inkjet head chip in which discharge nozzles and non-discharge nozzles (channels not communicating with the nozzle holes) are alternately disposed side by side.

In the above-mentioned inkjet head chip, it is desired that discharge speeds of the respective nozzle holes disposed in a row be made uniform for improving image quality of a printed matter by an inkjet printer.

For this purpose, there has been conventionally proposed a technology of optimizing a driving waveform as described in JP 2006-224545 A. This technology is applicable to the shared wall type inkjet head chip. In this technology, when a discharge channel which discharges ink sporadically or intermittently does not discharge ink, a pulse which is so short that ink is not discharged is applied in response to a restoration timing of the discharge channel which has discharged ink. This technology solves a problem that an ink discharge speed of a nozzle hole of a discharge channel which discharges ink sporadically or intermittently is slower than an ink discharge speed of a nozzle hole of a discharge channel which discharges ink successively. Accordingly, ink discharge speeds of the respective nozzle holes can be made uniform.

However, in the above-mentioned conventional technology, a difference in ink discharge speed of the nozzle hole is generated between discharge channels disposed in a middle portion of the discharge channels in a channel parallel direction and discharge channels disposed in both end portions thereof in the channel parallel direction, which causes a problem that ink discharge speeds of the respective nozzle holes cannot be made sufficiently uniform. More specifically, in the shared wall type inkjet head chip, discharge speeds of the nozzle holes disposed in both end portions of the inkjet head chip are slower compared with the nozzle holes disposed in a middle portion thereof, and in the independent channel type inkjet head chip, discharge speeds of the nozzle holes disposed in both end portions of the inkjet head chip are faster compared with the nozzle holes disposed in a middle portion thereof. As to the cause of the difference in ink discharge speed as described above, it is conceivable that an electrical condition is different between the discharge channels disposed in the both end portions and the discharge channels disposed in the middle portion. In other words, a number of other discharge channels are formed on both sides of each of the discharge channels disposed in the middle portion, and thus an electric field applied to the other discharge channels affects the discharge channels disposed in the middle portion from the both sides thereof. On the other hand, a number of other discharge channels are formed only on one side of each thereof, and hence an electric field applied to the other discharge channels affects the discharge channels disposed in the both end portions only from the one side thereof.

Further, as a similar phenomenon, for example, when ink droplets are discharged from several nozzle holes located in the vicinity of the center portion, a difference is generated in ink discharge speed of the nozzle holes disposed in both ends of the several nozzle holes.

SUMMARY OF THE INVENTION

The present invention has been made in view of the above-mentioned conventional problems, and therefore an object thereof is to provide an inkjet head chip, a manufacturing method for an inkjet head chip, an inkjet head, and an inkjet head recording apparatus which hardly generate a difference in ink discharge speeds of a plurality of nozzle holes and are capable of making ink discharge speeds of the respective nozzle holes uniform.

An inkjet head chip according to the present invention includes: an ink chamber for containing ink; a plurality of piezoelectric elements deformable by applying a voltage; a plurality of channels partitioned with the plurality of piezoelectric elements and formed parallel to each other; a nozzle hole disposed in one end of the plurality of channels in a longitudinal direction, for discharging an ink droplet toward a recording medium; and an actuator plate including the plurality of channels formed therein, in which: the actuator plate has a structure in which at least a piezoelectric layer and a low-permittivity substrate layer are laminated together, the piezoelectric layer being formed of a piezoelectric material forming the plurality of piezoelectric elements, the low-permittivity substrate layer being formed of an insulating low-permittivity material having a lower permittivity compared with the piezoelectric material; and the insulating low-permittivity material is exposed on bottom surfaces of the plurality of channels.

Owing to the above-mentioned features, the plurality of piezoelectric elements are applied with a voltage to be deformed. As a result, volumes of the channels adjacent to the deformed piezoelectric elements are contracted, whereby the ink contained in each of the channels is discharged from the nozzle hole. On this occasion, the channels applied with a voltage are in electrical conditions approximate to each other. In other words, the adjacent piezoelectric elements are in a state of being electrically separated from each other by means of the low-permittivity substrate layer, and hence the respective channels are hardly affected by the electric field applied to other channel. Therefore, the respective channels to be driven are in the electrical conditions approximate to each other.

Further, in the inkjet head chip according to the present invention, the plurality of channels preferably include: a discharge channel communicating with the nozzle hole and also communicating with the ink chamber through an ink introduction hole, and a non-discharge channel in which supply of the ink from the ink chamber is interrupted; a plurality of the discharge channels and a plurality of the non-discharge channels are preferably alternately disposed in a channel parallel direction; one end of the discharge channel is preferably extended to an end surface of the actuator plate in a state in which the insulating low-permittivity material is exposed on a bottom surface thereof, and another end of the discharge channel is preferably extended nearly to the end surface of the actuator plate; and the non-discharge channel is preferably extended over at least an entire length of the actuator plate in a state in which the insulating low-permittivity material is exposed on a bottom surface thereof.

The above-mentioned inkjet head chip is a so-called independent channel type inkjet head chip and has a structure in which one discharge channel and the piezoelectric elements disposed on both sides thereof form one discharge unit, and the discharge units are arranged parallel to each other through the non-discharge channels. Further, the non-discharge channels are extended over the entire length of the actuator plate in the state in which the insulating low-permittivity material is exposed on the bottom surfaces thereof, and thus the adjacent discharge channels are in a state of being electrically separated from each other also in another end (side opposed to the nozzle hole) of the actuator plate in the channel longitudinal direction, and the respective discharge channels are in a state of being completely electrically independent from each other. For this reason, the respective discharge channels are hardly affected by the electric field applied to other discharge channel, and therefore are in the uniform electrical condition.

Further, in the inkjet head chip according to the present invention, the plurality of channels each may be a discharge channel communicating with the nozzle hole and also communicating with the ink chamber through an ink introduction hole; and one end of the discharge channel may be extended to an end surface of the actuator plate in a state in which the insulating low-permittivity material is exposed on a bottom surface thereof, and another end of the discharge channel may be extended nearly to the end surface of the actuator plate.

The above-mentioned inkjet head chip is a so-called shared wall type inkjet head chip and has a structure in which the discharge channels are arranged parallel to each other through the piezoelectric elements, and the respective discharge channels are hardly affected by the electric field applied to other discharge channel.

Further, in the inkjet head chip according to the present invention, the actuator plate preferably includes a low-permittivity layer which is formed of the insulating low-permittivity material having the lower permittivity compared with the piezoelectric material, is laminated on the low-permittivity substrate layer, and is adjacent to the piezoelectric layer; and the another end of the discharge channel is preferably blocked by the low-permittivity layer.

As a result, the adjacent piezoelectric elements are completely electrically separated from each other by means of the low-permittivity substrate layer and the low-permittivity layer, and hence the respective discharge units are in a state of being completely electrically independent from each other. For this reason, the respective discharge channels are hardly affected by the electric field applied to other discharge channel, and therefore are in the uniform electrical condition.

According to the present invention, there is provided a manufacturing method for an inkjet head chip, the inkjet head chip including: an ink chamber for containing ink; a plurality of piezoelectric elements deformable by applying a voltage; a plurality of channels partitioned with the plurality of piezoelectric elements and formed parallel to each other; and a nozzle hole disposed in one end of the plurality of channels in a longitudinal direction, for discharging an ink droplet toward a recording medium, the manufacturing method including: cutting, on a surface of a laminated plate formed by laminating at least a piezoelectric layer formed of a piezoelectric material forming the plurality of piezoelectric elements and a low-permittivity substrate layer formed of an insulating low-permittivity material having a lower permittivity compared with the piezoelectric material on the piezoelectric layer side, the plurality of channels parallel to each other with a depth at which the insulating low-permittivity material is exposed, to form an actuator plate including the plurality of channels formed therein; forming electrodes on side surfaces of a piezoelectric body formed between the adjacent channels to form the plurality of piezoelectric elements; and bonding an ink chamber plate including the ink chamber and an ink introduction hole for introducing the ink contained in the ink chamber to the plurality of channels formed therein to the piezoelectric layer of the actuator plate, and bonding a nozzle plate including the nozzle hole formed therein to one end of the actuator plate in a channel longitudinal direction.

In this manner, the piezoelectric layer is laminated on the low-permittivity substrate layer to form the laminated plate, and then the channels are cut on the surface of the laminated plate on the piezoelectric layer side to form the actuator plate. After that, the ink chamber plate and the nozzle plate are each bonded to the actuator plate, whereby the above-mentioned inkjet head chip is manufactured. Further, when being formed, the channels are cut with such the depth that the insulating low-permittivity material is exposed, with the result that the adjacent piezoelectric elements are electrically separated from each other by means of the low-permittivity substrate layer.

An inkjet head according to the present invention includes the above-mentioned inkjet head chip.

An inkjet recording apparatus according to the present invention includes: the above-mentioned inkjet head; ink supply means for supplying ink to an ink chamber of an inkjet head chip included in the inkjet head; and recording medium transport means for transporting a recording medium so as to pass through a position opposed to a nozzle hole of the inkjet head chip.

Owing to the above-mentioned features, an ink droplet is sprayed from the nozzle hole of the inkjet head chip onto the recording medium transported by the recording medium transport means. On this occasion, the respective channels are each in the electrical conditions approximate to each other without being affected by the electric field of the piezoelectric element of another channel, whereby discharge speeds of ink droplets of the plurality of nozzle holes can be made uniform.

With the inkjet head chip, the manufacturing method for an inkjet head chip, the inkjet head, and the inkjet recording apparatus according to the present invention, the respective channels are each in the electrical conditions approximate to each other, and a difference in ink discharge speed of the plurality of nozzle holes is hardly caused, whereby the ink discharge speeds can be made uniform. Accordingly, image quality of printing can be improved.

DETAILED DESCRIPTION OF THE PREFERRED EMBODIMENTS

Hereinafter, a description is given of embodiments of an inkjet head chip, a manufacturing method for an inkjet head chip, an inkjet head, and an inkjet recording apparatus according to the present invention with reference to the drawings.

First Embodiment

First, a first embodiment of the present invention is described.

Figure 1:
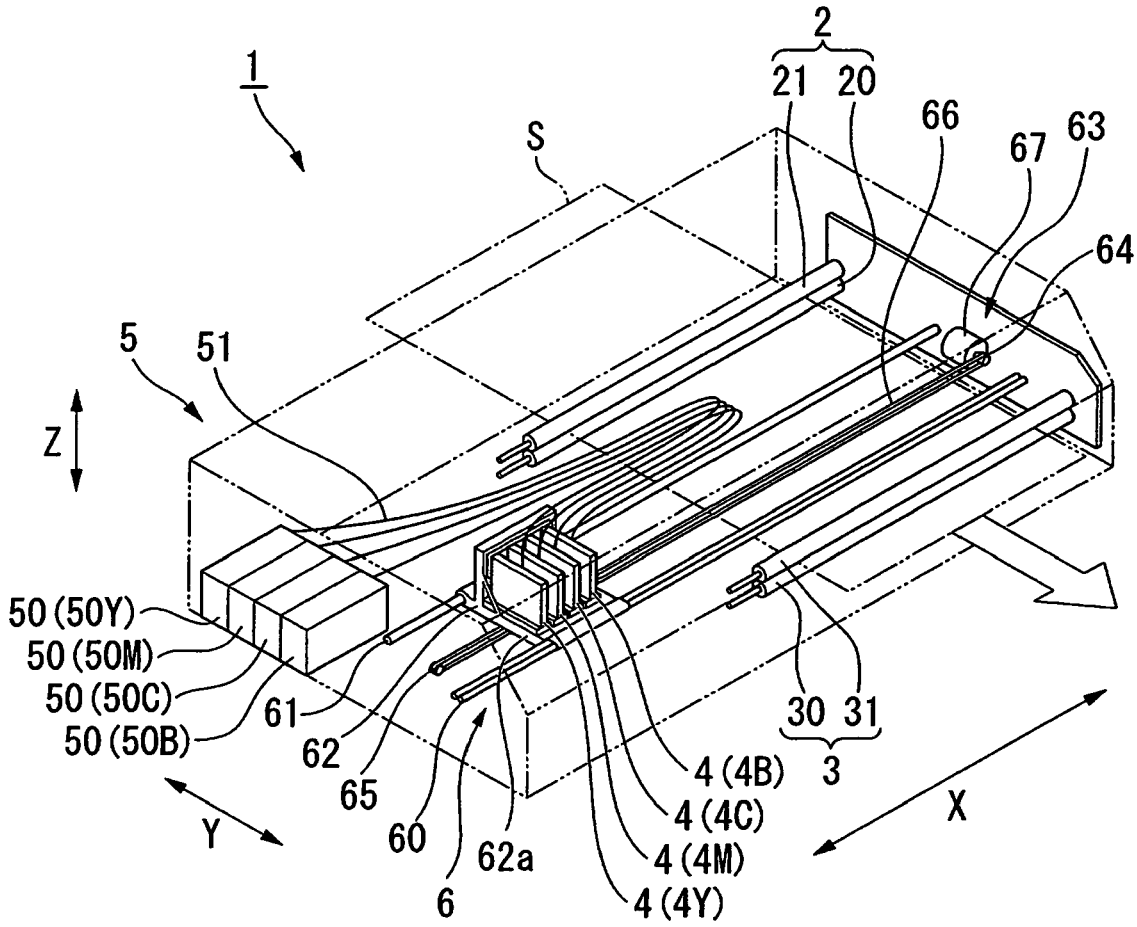
FIG. 1 is a perspective view for illustrating an inkjet recording apparatus according to a first embodiment of the present invention.
Figure 2:
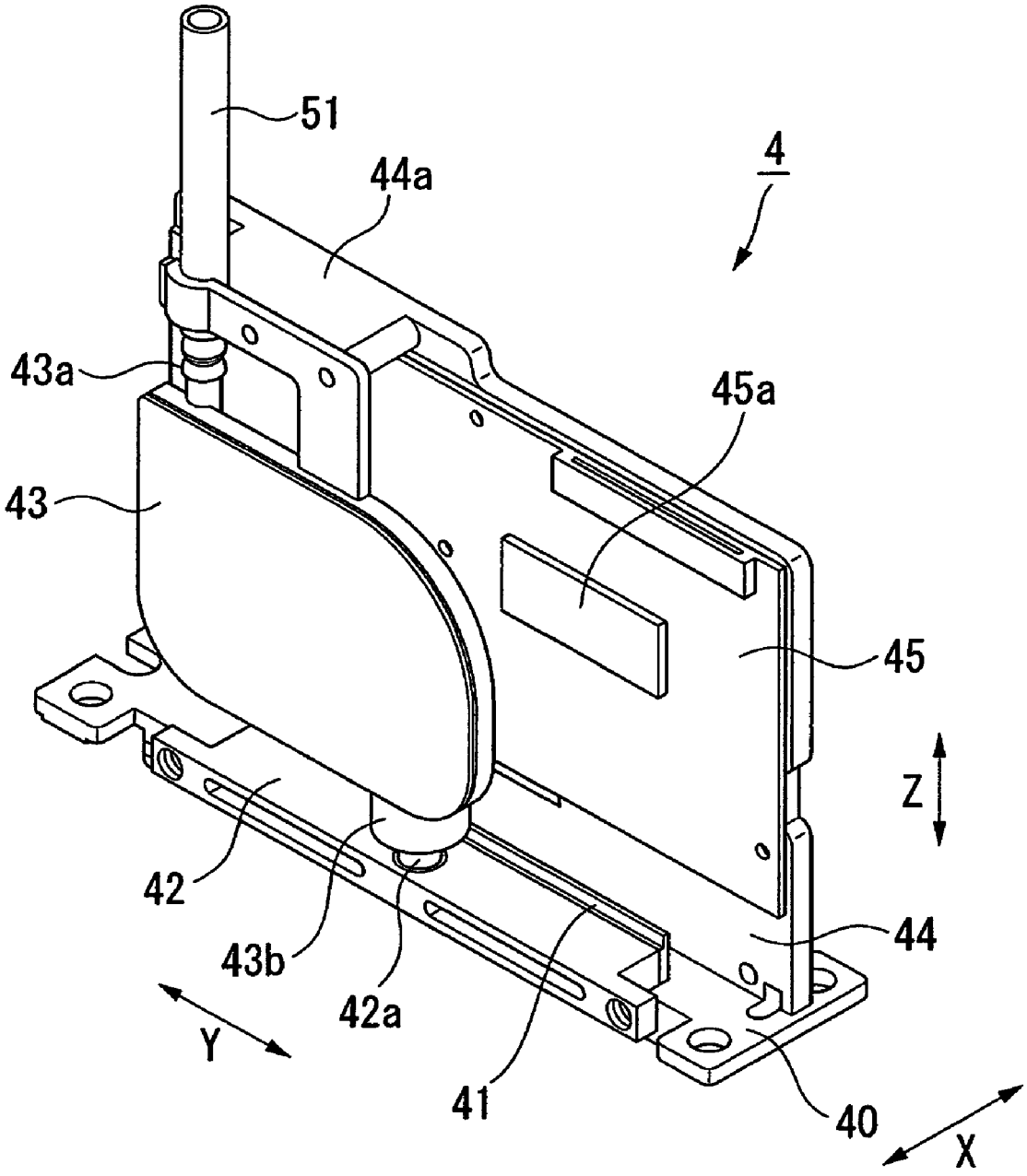
FIG. 2 is a perspective view for illustrating an inkjet head according to the first embodiment of the present invention.
Figure 3:
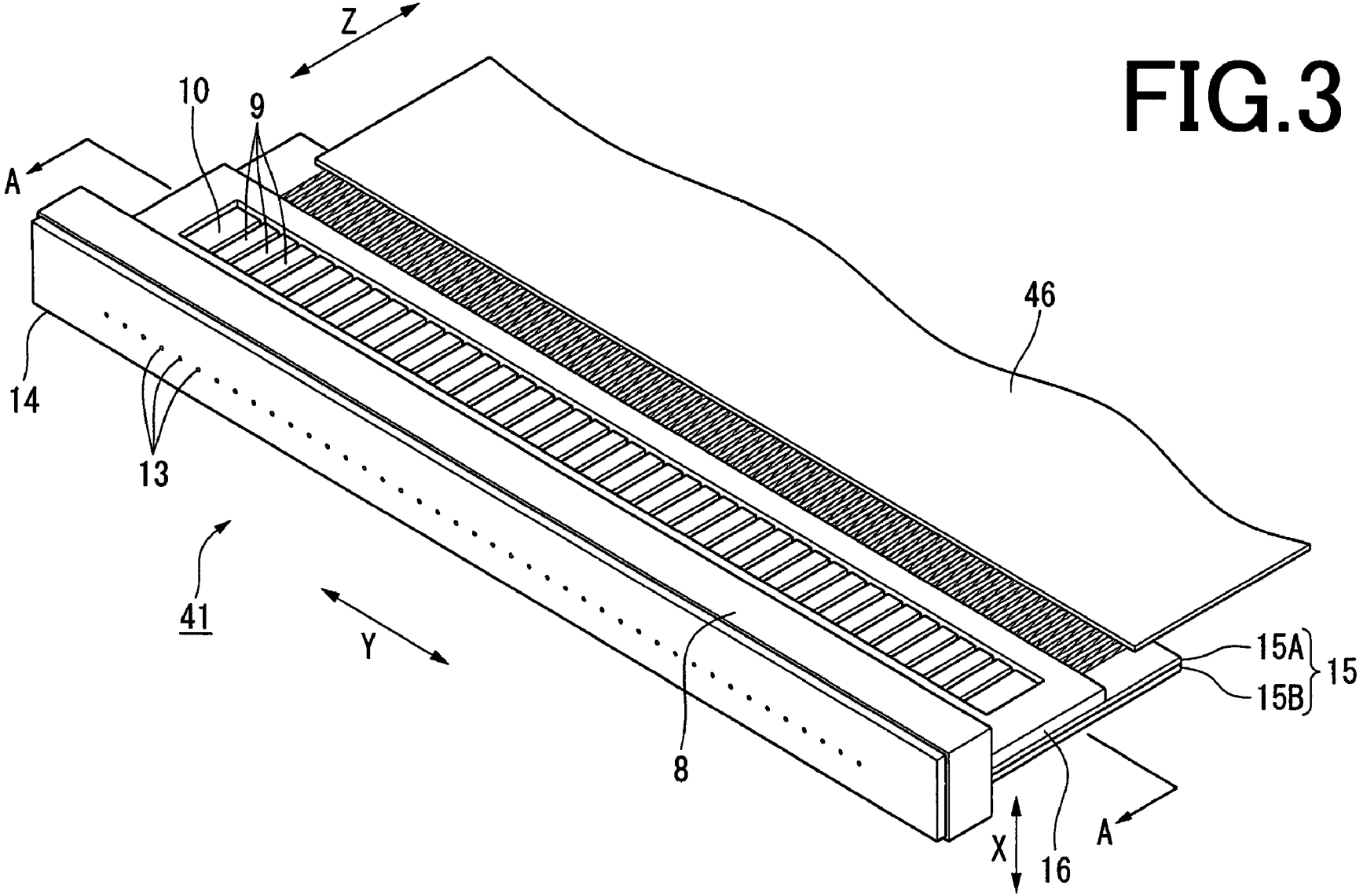
FIG. 3 is a perspective view for illustrating an inkjet head chip according to the first embodiment of the present invention.
Figure 4:
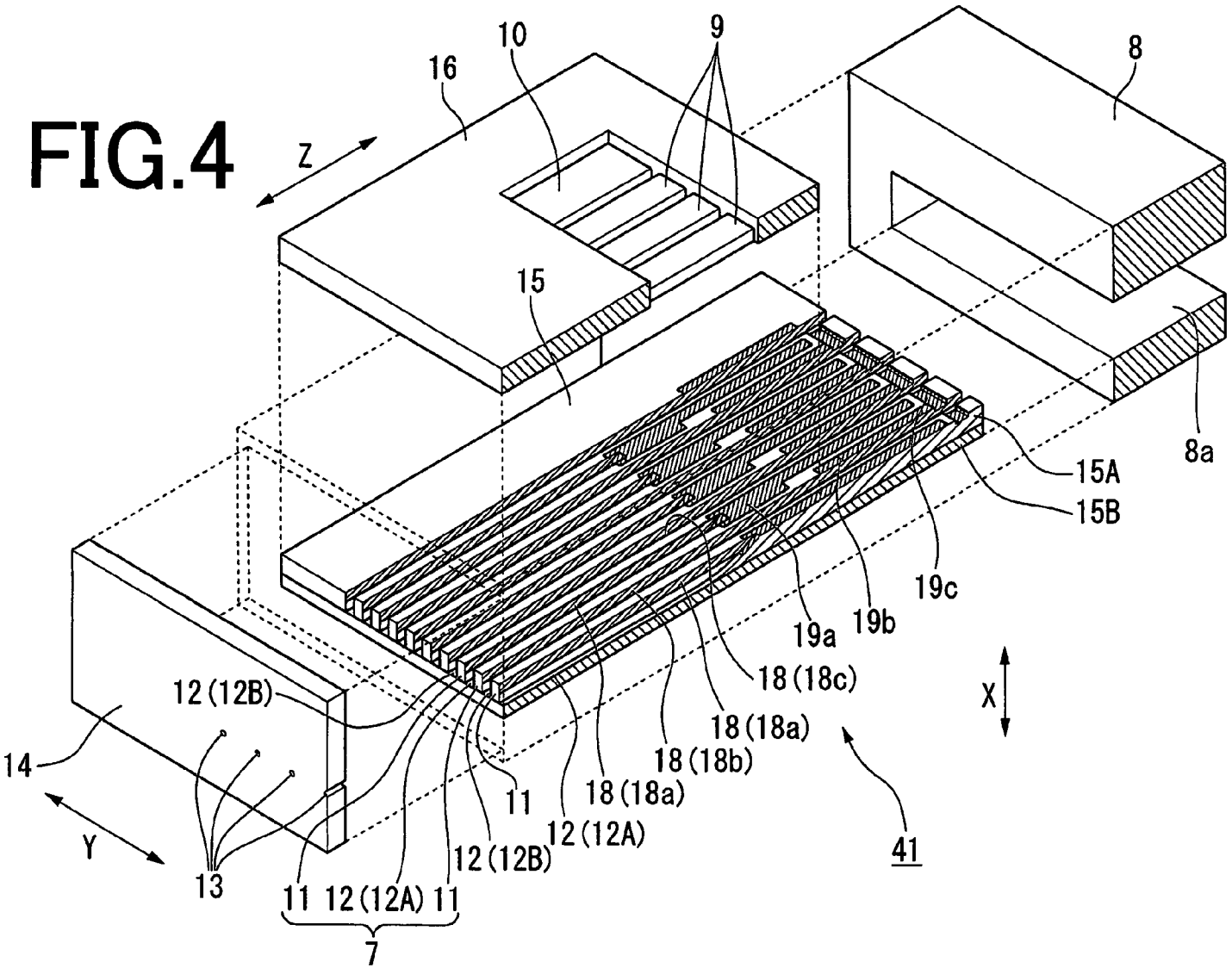
FIG. 4 is an exploded perspective view for illustrating the inkjet head chip according to the first embodiment of the present invention.
Figure 5:
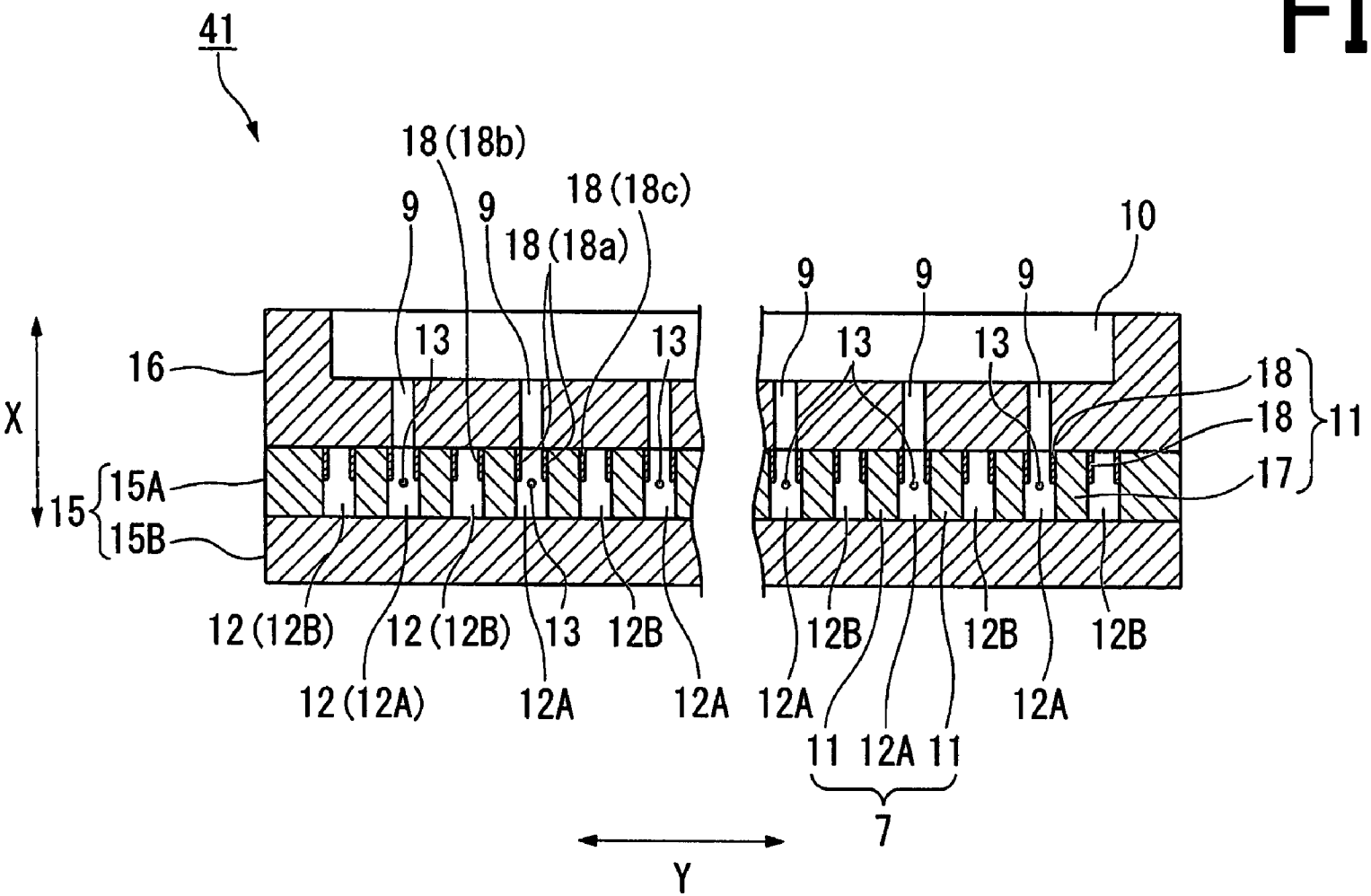
FIG. 5 is a cross-sectional view taken along an arrow A-A of FIG. 3.

FIG. 1 is a perspective view illustrating an example of the inkjet recording apparatus according to the present invention. FIG. 2 is a perspective view illustrating the inkjet head including the inkjet head chip according to the present invention. FIG. 3 is a perspective view illustrating an example of the inkjet head chip according to the present invention. FIG. 4 is an exploded perspective view of an inkjet head chip 41 illustrated in FIG. 3. FIG. 5 is a cross-sectional view taken along an arrow A-A of FIG. 3.

As illustrated in FIG. 1, an inkjet recording apparatus 1 includes a pair of transport means 2 and 3 for transporting a recording medium S such as paper, an inkjet head 4 for discharging ink onto the recording medium S, ink supply means 5 for supplying ink to the inkjet head 4, and scanning means 6 for causing the inkjet head 4 to scan in a direction (hereinafter, referred to as X direction) substantially orthogonal to a transport direction (hereinafter, referred to as Y direction) of the recording medium S.

The pair of transport means 2 and 3 include grid rollers 20 and 30 each extended in X direction, pinch rollers 21 and 31 each extended parallel to the grid rollers 20 and 30, and a drive mechanism (not shown) such as a motor which causes the grid rollers 20 and 30 to axially rotate, respectively.

The ink supply means 5 includes an ink tank 50 containing ink and an ink supply tube 51 for connecting the ink tank 50 with the inkjet head 4. A plurality of the ink tanks 50 are provided, and more specifically, ink tanks 50Y, 50M, 50C, and 50B for four kinds of ink of yellow, magenta, cyan, and black are arranged in Y-direction. The ink supply tube 51 is formed of a flexible hose having flexibility, which is capable of responding to an operation of the inkjet head 4 (carriage 62).

The scanning means 6 includes a pair of guide rails 60 and 61 extended in X direction, the carriage 62 capable of sliding along the pair of guide rails 60 and 61, and a drive mechanism 63 which moves the carriage 62 in X direction. The drive mechanism 63 includes a pair of pulleys 64 and 65 disposed between the pair of guide rails 60 and 61, an endless belt 66 wound between the pair of pulleys 64 and 65, and a drive motor 67 which rotatably drives the pulley 64. The pair of pulleys 64 and 65 are disposed between both ends of the pair of guide rails 60 and 61, respectively, and are disposed with an interval in X direction. The endless belt 66 is disposed between the pair of guide rails 60 and 61, and the carriage 62 is coupled to the endless belt 66. The carriage 62 is equipped with a plurality of the inkjet heads 4, and specifically, inkjet heads 4Y, 4M, 4C, and 4B for four kinds of ink of yellow, magenta, cyan, and black are arranged in X direction.

As illustrated in FIG. 2, the inkjet head 4 includes amounting base 40, the inkjet head chip 41, a flow path substrate 42, a pressure adjustment unit 43, a base plate 44, and a wiring board 45. The mounting base 40 is fixed to a base 62*a* of the carriage 62 with a screw or the like, and the inkjet head chip 41 is mounted onto the mounting base 40. The flow path substrate 42 is mounted onto one surface of the inkjet head chip 41. A flow path (not shown) for distributing ink is formed inside the flow path substrate 42, and an inflow port 42*a* communicating with the flow path is formed on a top surface of the flow path substrate 42. The pressure adjustment unit 43 is used for absorbing pressure fluctuation of ink, and includes a reservoir (not shown) for reserving ink. The pressure adjustment unit 43 is fixed to a distal end of a support unit 44*a* mounted on a top end of the base plate 44 to protrude therefrom. An ink intake port 43*a* connected with the ink supply tube 51 is provided above the pressure adjustment unit 43, and an ink discharge port 43*b* connected with the inflow port 42*a* of the flow path substrate 42 is provided under the pressure adjustment unit 43. The base plate 44 is held upright relative to a top surface of the mounting base 40 so as to be substantially perpendicular thereto, and the wiring board 45 is mounted onto the surface of the base plate 44. The wiring board 45 includes a control circuit 45*a* which controls the inkjet head chip 41 formed therein.

As illustrated in FIG. 3 and FIG. 4, the inkjet head chip 41 includes an ink chamber 10 containing ink, piezoelectric elements 11 deformable by applying a voltage, a plurality of channels 12 partitioned with the piezoelectric elements 11 and formed parallel to each other, and nozzle holes 13 which discharge an ink droplet toward the recording medium S illustrated in FIG. 1.

More specifically, the inkjet head chip 41 is a so-called independent channel type inkjet head chip, and includes a nozzle plate 14 including the nozzle holes 13 formed therein, an actuator plate 15 in which the plurality of piezoelectric elements 11 are held upright relative thereto parallel to each other at intervals and the plurality of channels 12 are formed, an ink chamber plate 16 including the ink chamber 10 formed therein, and a nozzle cap 8 for supporting the nozzle plate 14.

The actuator plate 15 is a rectangular plate having a structure in which a piezoelectric layer 15A is laminated on a low-permittivity substrate layer 15B. The piezoelectric layer 15A is formed of, for example, a piezoelectric material such as lead zirconate titanate (PZT) forming the piezoelectric element 11. The low-permittivity substrate layer 15B is formed of an insulating low-permittivity material having a lower permittivity compared with the piezoelectric material (for example, alumina ceramics, aluminum nitride, or zirconia). On one surface (piezoelectric layer 15A side) of the actuator plate 15, the recessed-groove-like channels 12 which extend in a shorter side direction (hereinafter, referred to as Z direction) of the actuator plate 15 and have a rectangular shape in cross section are formed. The plurality of channels 12 are arranged at predetermined intervals in a longitudinal direction (Y direction) of the actuator plate 15.

As illustrated in FIG. 4 and FIG. 5, the insulating low-permittivity material is exposed on a bottom surface of the above-mentioned channel 12. More specifically, the channel 12 is formed with a depth equal to a thickness of the piezoelectric layer 15A, and the bottom surface of the channel 12 is flush with an interface between the piezoelectric layer 15A and the low-permittivity substrate layer 15B. In other words, the bottom surface of the channel 12 is formed of the insulating low-permittivity material, and an inner surface of the channel 12 is formed of a piezoelectric material.

Further, the channels 12 include a plurality of discharge channels 12A (common channels) and a plurality of non-discharge channels 12B (active channels) each disposed between the adjacent discharge channels 12A. The discharge channels 12A and the non-discharge channels 12B are alternately arranged in a channel parallel direction (Y direction). In other words, a pair of adjacent piezoelectric elements 11 and one discharge channel 12A formed therebetween form one discharge unit 7, and the discharge units 7 are provided in parallel in Y direction via the non-discharge channels 12B.

The discharge channel 12A is the channel 12 capable of discharging an ink droplet, which communicates with the nozzle hole 13 and also communicates with the ink chamber 10 via an ink introduction hole 9. As illustrated in FIG. 4, a distal end (end on the nozzle hole 13 side) of the discharge channel 12A is extended to an end surface of the actuator plate 15 in a state in which the insulating low-permittivity material is exposed on its bottom surface, and the distal end of the discharge channel 12A is blocked by the nozzle plate 14. A proximal end (end on a side opposite to the nozzle hole 13 side) of the discharge channel 12A is extended nearly to another end surface of the actuator plate 15. That is, the proximal end of the discharge channel 12A is blocked by the piezoelectric layer 15A. Further, the bottom surface of the proximal end of the discharge channel 12A is sloped so as to make the proximal end thereof gradually become slimmer toward the proximal end side thereof.

The non-discharge channel 12B is the channel 12 incapable of discharging an ink droplet and does not communicate with the ink chamber 10. Hence, supply of ink from the ink chamber 10 thereto is interrupted. As illustrated in FIG. 4, the non-discharge channel 12B is extended over the entire length of the actuator plate 15 in a state in which the insulating low-permittivity material is exposed on its bottom surface, a distal end of the non-discharge channel 12B is blocked by the nozzle plate 14, and a proximal end thereof is open.

The piezoelectric element 11 is formed between the adjacent channels 12. The piezoelectric element 11 includes a piezoelectric body 17 having a rectangular shape in cross section and drive electrodes 18 each provided on both side surfaces of the piezoelectric body 17. The piezoelectric body 17 is a side wall portion which is formed between the adjacent channels 12 so as to extend in Z direction, and is formed by forming a plurality of rectangular grooves (channels 12) parallel to each other at predetermined pitches on the surface of a laminated plate 15' in which the piezoelectric layer 15A is laminated on the low-permittivity substrate layer 15B (illustrated in FIGS. 6A to 6E) on the piezoelectric layer 15A side. The drive electrode 18 is a belt-like electrode extending in Z direction, and is deposited on a top of the side wall of the piezoelectric body 17.

The actuator plate 15 includes common extraction electrodes 19*a*, active extraction electrodes 19*b*, and connection electrodes 19*c*. The common extraction electrode 19*a* is disposed on one surface of the proximal end of the actuator plate 15 and is connected to a proximal end of a drive electrode 18*a* disposed on an inner surface of the discharge channel 12A. The active extraction electrodes 19*b* are disposed parallel to each other at intervals with respect to the common extraction electrodes 19*a*, and are each connected to drive electrodes 18*b* disposed on ones of inner surfaces of the non-discharge channels 12B provided on both sides of the discharge channel 12A so as to interpose the discharge channel 12A therebetween. The connection electrode 19*c* is an electrode which connects a proximal end of the drive electrode 18*b* disposed in one of the inner surfaces of each of the non-discharge channels 12B provided on the both sides of the discharge channel 12A with a proximal end of a drive electrode 18*c* provided on another one of the inner surfaces thereof, and is disposed on proximal end sides of the common extraction electrode 19*a* and the active extraction electrode 19*b*.

Further, a flexible substrate 46 having flexibility, which is illustrated in FIG. 3, is interposed between the proximal end of the actuator plate 15 and the wiring board 45. An electrode pattern (not shown) is formed on the flexible substrate 46, and the extraction electrodes 19*a* and 19*b* are connected to the control circuit 45*a* of the wiring board 45 via the electrode pattern.

The ink chamber plate 16 is a rectangular plate superimposed on the actuator plate 15, and is disposed so as to block the channels 12. The recessed-groove-like ink chamber 10 having a rectangular shape in plan view, which extends in a longitudinal direction (Y direction) of the ink chamber plate 16, is formed on one surface (side opposite to the actuator plate 15 side) of the ink chamber plate 16. The rectangular ink introduction holes 9 penetrating the ink chamber plate 16 toward another surface (actuator plate 15 side) are formed on a bottom surface of the ink chamber 10. The ink chamber 10 communicates with the discharge channel 12A through the ink introduction hole 9. In other words, the ink introduction holes 9 are disposed above the discharge channels 12A. On the other hand, the ink introduction hole 9 is not formed above the non-discharge channels 12B.

Further, the flow path substrate 42 illustrated in FIG. 2 is bonded to and superimposed on one surface of the ink chamber plate 16, and the ink chamber 10 communicates with the flow path (not shown) of the flow path substrate 42.

The nozzle plate 14 is a rectangular plate bonded to an end surface on the channel distal end side of the actuator plate 15, and is disposed so as to block the distal end side of the channel 12. In the nozzle plate 14, the plurality of nozzle holes 13 are arranged in a row in the channel parallel direction (Y direction). Those nozzle holes 13 are disposed at distal end positions of the discharge channels 12A, and are not provided at distal end positions of the non-discharge channels 12B.

The nozzle cap 8 is a block body including an opening 8*a* formed therein, in which the actuator plate 15 and the ink chamber plate 16 are inserted therethrough, and is bonded to aback surface (surface opposite to a surface facing the recording medium S) of the nozzle plate 14.

Here, a manufacturing method for the inkjet head chip 41 having the above-mentioned structure is described.

FIGS. 6A to 6E are cross-sectional views illustrating a manufacturing step for the inkjet head chip 41.

Figure 6A:
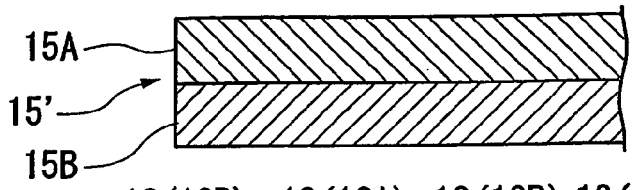
FIGS. 6A to 6E are cross-sectional views of the inkjet head chip, which illustrate a manufacturing method for an inkjet head chip according to the present invention.

As illustrated in FIG. 6A, first, the laminated plate 15' formed of the low-permittivity substrate layer 15B and the piezoelectric layer 15A laminated thereon is prepared.

Figure 6B:
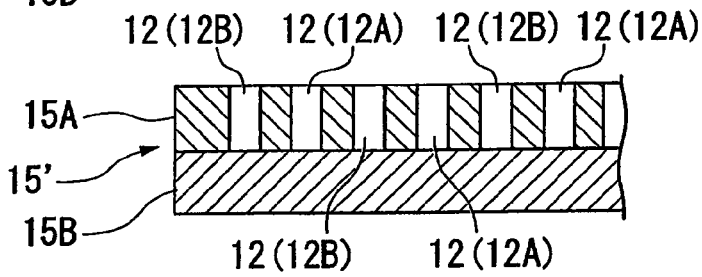

Then, as illustrated in FIG. 6B, there is performed a step of cutting the plurality of channels 12 (discharge channels 12A and non-discharge channels 12B) parallel to each other on a surface of the laminated plate 15' on the piezoelectric layer 15A side to form the actuator plate 15. On this occasion, the channels 12 are cut with a depth such that the insulating low-permittivity material of the low-permittivity substrate layer 15B is exposed. More specifically, the channels 12 are cut with the depth equal to the thickness of the piezoelectric layer 15A.

Figure 6C:
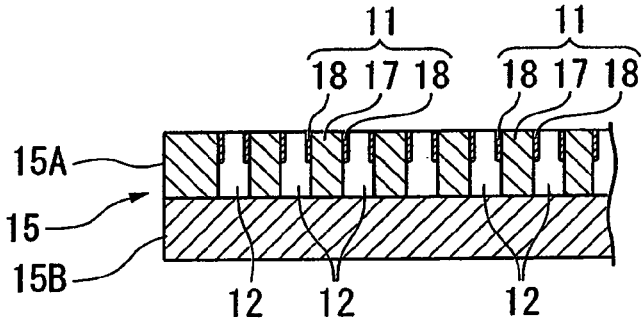

Next, as illustrated in FIG. 6C, there is performed a step of forming the drive electrodes 18 on the side surfaces of the piezoelectric body 17 formed between the adjacent channels 12 to form the piezoelectric element 11. On this occasion, the common extraction electrode 19*a*, the active extraction electrode 19*b*, and the connection electrode 19*c*, which are illustrated in FIG. 4, are also formed on the actuator plate 15.

Figure 6D:
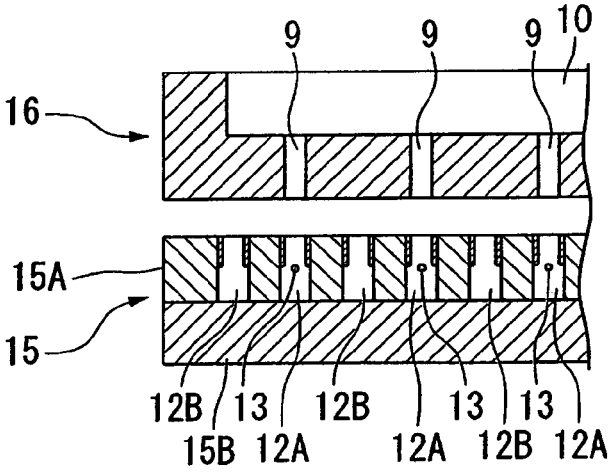

Next, as illustrated in FIG. 6D, there is performed a step of bonding the ink chamber plate 16 to the piezoelectric layer 15A of the actuator plate 15 and bonding the nozzle plate 14 illustrated in FIG. 4 to the distal end of the actuator plate 15 in the channel longitudinal direction. On this occasion, alignment between the ink chamber plate 16 and the actuator plate 15 is relatively performed so that the ink introduction holes 9 formed in the ink chamber plate 16 are disposed at positions of the discharge channels 12A. Moreover, alignment between the nozzle plate 14 and the actuator plate 15 is relatively performed so that the nozzle holes 13 formed in the nozzle plate 14 are disposed at positions of the discharge channels 12A.

Figure 6E:
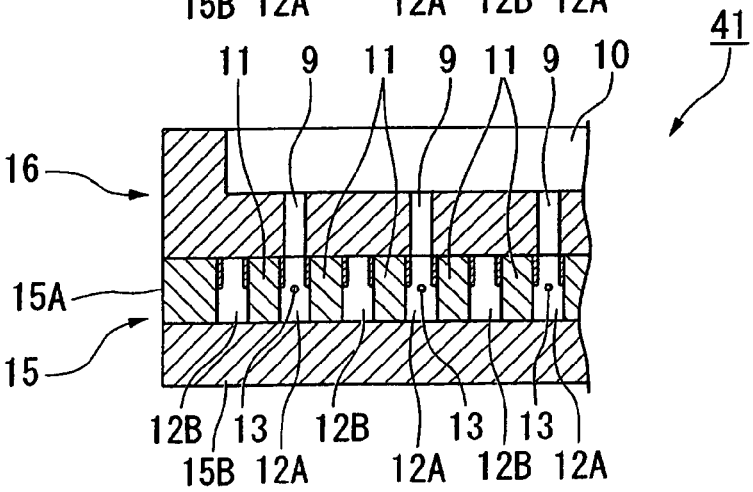

Through the above-mentioned steps, as illustrated in FIG. 6E, the inkjet head chip 41 having the above-mentioned structure is manufactured.

Next, a description is given of operations of the inkjet recording apparatus 1 having the above-mentioned structure and the inkjet head chip 41 manufactured by the above-mentioned manufacturing method.

First, ink contained in the ink tank 50 is supplied to the inkjet head 4 by the ink supply means 5. More specifically, the ink contained in the ink tank 50 flows toward the inkjet head 4 side through the ink supply tube 51, and flows into the pressure adjustment unit 43 from the ink intake port 43*a*. The ink stored in the pressure adjustment unit 43 flows from the ink discharge port 43*b*, flows into the flow path substrate 42 from the inflow port 42*a*, and is supplied into the ink chamber 10 of the inkjet head chip 41 through the flow path of the flow path substrate 42. The ink contained in the ink chamber 10 flows into the respective discharge channels 12A through the ink introduction holes 9. It should be noted that the ink introduction holes 9 are not formed at positions of the non-discharge channels 12B, and hence the ink contained in the ink chamber 10 does not flow into the non-discharge channels 12B, whereby the non-discharge channels 12B are empty.

Next, the recording medium S is transported in Y direction by the pair of transport means 2 and 3. More specifically, the grid roller 20 disposed on the upstream side is caused to axially rotate by the drive mechanism (not shown) in a state in which the recording medium S is sandwiched between the grid roller 20 and the pinch roller 21 which are disposed on the upstream side. Accordingly, the recording medium S passes under the inkjet head chip 41 (nozzle plate 14) to be transported in Y direction. The recording medium S which has passed under the inkjet head chip 41 is sandwiched between the grid roller 30 and the pinch roller 31 which are disposed on a downstream side. Then, the grid roller 30 disposed on the downstream side is caused to axially rotate by the drive mechanism (not shown), whereby the recording medium S is delivered.

On the other hand, while the recording medium S passes under the inkjet head 4 (inkjet head chip 41) as described above, the inkjet head 4 is caused to scan in X direction by the scanning means 6. More specifically, first, the drive motor 67 of the drive mechanism 63 is driven, to thereby rotatably drive the pulley 64 of the pair. As a result, the endless belt 66 is circulated and moved between the pair of pulleys 64 and 65, and the carriage 62 fixed to the endless belt 66 is moved in X direction, with the result that the plurality of inkjet heads 4 mounted onto the carriage 62 are caused to scan in X direction.

Further, the inkjet head 4 sprays an ink droplet onto the recording medium S while performing the above-mentioned scanning operation by the inkjet head 4. More specifically, a drive signal is sent to the control circuit 45*a* of the wiring board 45, and a voltage is applied to the drive electrodes 18 of the piezoelectric element 11 from the control circuit 45*a* through the electrode pattern (not shown) of the flexible substrate 46, the common extraction electrode 19*a*, the active extraction electrode 19*b*, and the connection electrode 19*c*. As a result, the piezoelectric elements 11 disposed on both sides of the discharge channel 12A are deformed into a curved shape so as to expand toward the discharge channel 12A. When the piezoelectric elements 11 disposed on both sides of the discharge channel 12A are deformed as described above, a volume of the discharge channel 12A is contracted, and hence the ink contained in the discharge channel 12A is discharged from the nozzle hole 13.

In this case, the adjacent piezoelectric elements 11 are in a state of being electrically separated from each other by the low-permittivity substrate layer 15B, and the respective discharge channels 12A to be driven are less likely to be affected by an electric field applied to other channels 12. Accordingly, the respective discharge channels 12A applied with a voltage are in electrical conditions approximate to each other.

In particular, in the above-mentioned inkjet head chip 41, the non-discharge channels 12B are extended over the entire length of the actuator plate 15 in a state in which the insulating low-permittivity material is exposed on bottom surfaces thereof, and thus the adjacent discharge channels 12A are electrically separated from each other also in the proximal end in the channel longitudinal direction, whereby the respective discharge channels 12A are completely electrically independent from each other. As a result, the electric field applied to the other discharge channels 12A has almost no effect on the respective discharge channels 12A, and hence the respective discharge channels 12A are in a uniform electrical condition.

According to the inkjet head chip 41 with the above-mentioned structure, the manufacturing method for the inkjet head chip 41, and the inkjet recording apparatus 1, the discharge channels 12A are each in the electrical conditions approximate to each other, whereby a difference in ink discharge speed of the plurality of nozzle holes 13 is hardly caused, which makes the ink discharge speeds uniform. Thus, image quality of printing can be improved.

In particular, according to the above-mentioned inkjet head chip 41, the non-discharge channels 12B are extended over the entire length of the actuator plate 15 in the state in which the insulating low-permittivity material of the low-permittivity substrate layer 15B is exposed on bottom surfaces thereof, and the respective discharge channels 12A are completely electrically independent from each other, whereby the difference in ink discharge speed is less likely to occur. Accordingly, the image quality of the printing can be further improved.

Second Embodiment

Next, a second embodiment of the present invention is described.

It should be noted that the second embodiment is similar to the first embodiment described above in the structures other than that of an inkjet head chip 141, and hence the same structures as in the first embodiment are denoted by the same reference numerals and symbols, and their descriptions are omitted.

Figure 7:
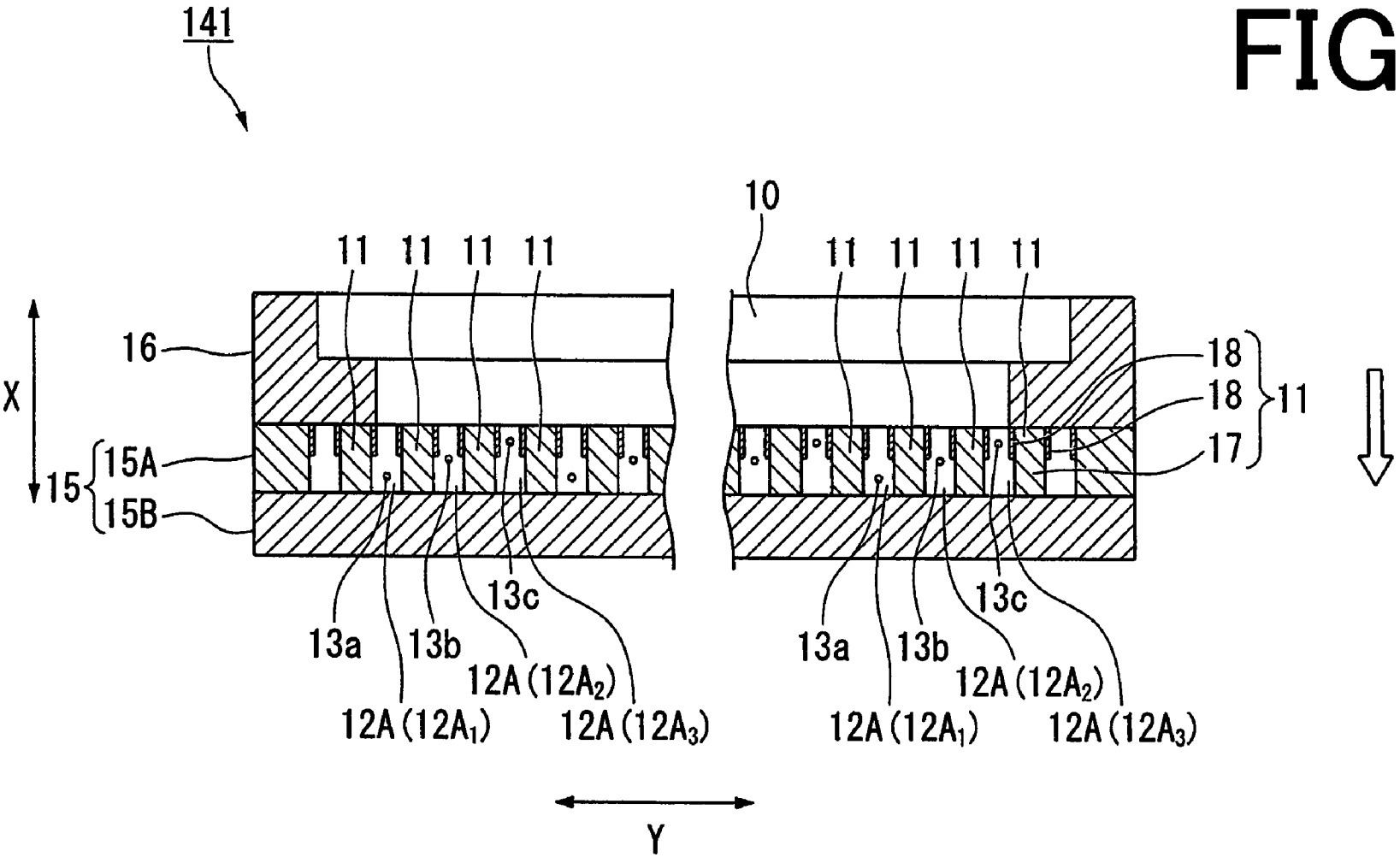
FIG. 7 is a cross-sectional view for illustrating an inkjet head chip according to a second embodiment of the present invention.

FIG. 7 is a cross-sectional view illustrating an example of the inkjet head chip according to the present invention.

As illustrated in FIG. 7, the inkjet head chip 141 is a so-called shared wall type inkjet head chip in which the discharge channels 12A are successively arranged. The plurality of channels 12 extending in a shorter side direction (Z direction) of the actuator plate 15 are formed at predetermined intervals in the channel parallel direction on one surface (piezoelectric layer 15A side) of the actuator plate 15, and the plurality of channels 12 are each communicating with the nozzle holes 13 and also with the ink chamber 10. In other words, the plurality of channels 12 are each the discharge channels 12 which discharge an ink droplet, and each have the structure in which the discharge channels 12A are adjacent to the piezoelectric element 11 on both sides thereof. The distal ends (ends on the nozzle hole 13 side) of the discharge channels 12A are extended to the end surface of the actuator plate 15 in a state in which the insulating low-permittivity material is exposed on bottom surfaces thereof, and the proximal ends (ends on the side opposed to the nozzle hole 13) of the discharge channels 12A are extended nearly to the end surface of the actuator plate 15.

Further, as to the plurality of nozzle holes 13 formed in the nozzle plate 14, continuously-formed three nozzle holes 13*a*, 13*b*, and 13*c* form a pair, and the three nozzle holes 13*a*, 13*b*, and 13*c* are formed at positions displaced from each other in a depth direction (X direction) of the channel 12A. More specifically, the nozzle hole 13*b* located in the middle of the nozzle holes 13*a*, 13*b*, and 13*c* is formed in a center portion of the piezoelectric layer 15A in the channel depth direction, the nozzle hole 13*a* disposed on one side (left side in FIG. 7) is formed on the low-permittivity substrate layer 15B side (lower side in FIG. 7) in the channel depth direction, and the nozzle hole 13*c* disposed on another side (right side in FIG. 7) is formed on the surface side of the piezoelectric layer 15A in the channel depth direction.

Next, an action of the inkjet head chip 141 with the above-mentioned structure is described.

The inkjet head chip 141 of the inkjet head 4 sprays an ink droplet onto the recording medium S while the inkjet head 4 is caused to scan as in the case of the first embodiment described above. More specifically, a voltage is applied to the drive electrodes 18 of the piezoelectric element 11 to deform the piezoelectric element 11 into a curved shape toward the channel, and volumes of discharge channels $\mathbf{12}A_1$ to $\mathbf{12}A_3$ communicating with the above-mentioned three nozzle holes 13*a*, 13*b*, and 13*c*, respectively, are successively contracted, whereby ink droplets are successively discharged from the three nozzle holes 13*a*, 13*b*, and 13*c*. For example, in the case where the inkjet head 4 scans in an arrow direction illustrated in FIG. 7, ink droplets are successively sprayed from the nozzle hole 13*a* disposed on the one side of the channels, the nozzle hole 13*b* located in the middle portion thereof, and the nozzle hole 13*c* disposed on the another side thereof. Accordingly, the ink droplets discharged from the three nozzle holes 13*a*, 13*b*, and 13*c*, respectively, are arranged in Y direction on the recording medium S, whereby a straight line extending in Y direction is drawn. Further, in the case where a volume of one among the discharge channels $\mathbf{12}A_1$ to $\mathbf{12}A_3$ (for example, discharge channel $\mathbf{12}A_2$) is contracted to discharge an ink droplet from the nozzle hole 13 (for example, nozzle hole 13*b* located in the middle portion), volumes of other discharge channels 12A (for example, discharge channels $\mathbf{12}A_1$ and $\mathbf{12}A_3$) are expanded, whereby the ink droplets are not discharged from other nozzle holes 13 (for example, nozzle holes 13*a* and 13*c* disposed on the one end and another end of the channels).

According to the inkjet head chip 141 with the above-mentioned structure, the respective discharge channels 12A are hardly affected by the electric field applied to other discharge channel 12A, and the respective discharge channels 12A are in the electrical conditions approximate to each other, and hence a difference in ink discharge speed is less likely to occur. As a result, ink discharge speeds can be made uniform, which improves image quality of printing.

Further, according to the inkjet head chip 141 described above, the discharge channels 12A are successively arranged, with the result that the number of the nozzle holes 13 can be increased without changing a length of the inkjet head chip 141 in the channel parallel direction.

Third Embodiment

Next, a third embodiment of the present invention is described.

It should be noted that the third embodiment is similar to the second embodiment described above in the structures other than that of an actuator plate 115, and hence the same structures as in the first embodiment and the second embodiment are denoted by the same reference numerals and symbols, and their descriptions are omitted.

Figure 8:
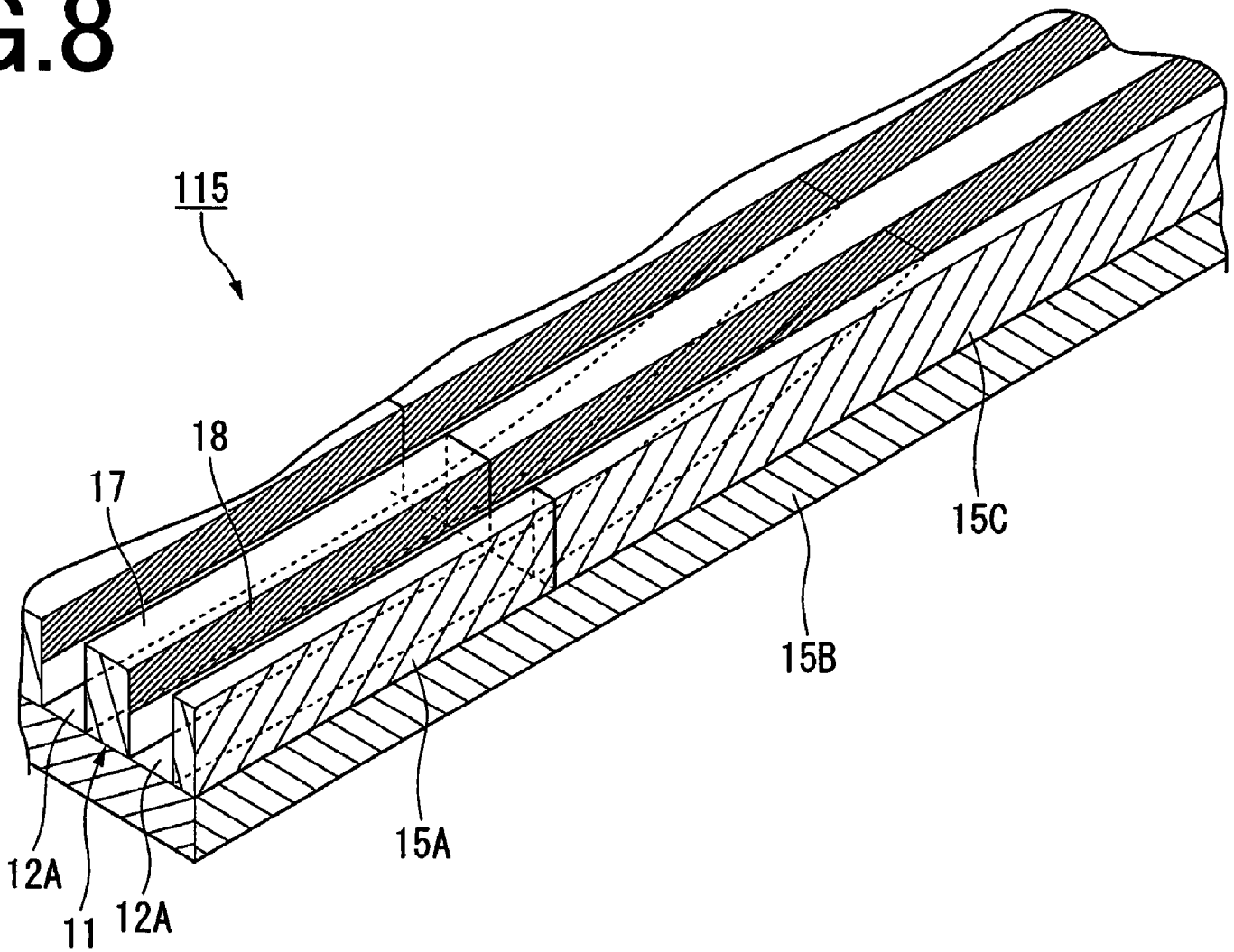
FIG. 8 is a partially enlarged perspective view for illustrating an actuator plate according to a third embodiment of the present invention.

FIG. 8 is a partially enlarged perspective view of the actuator plate 115.

The actuator plate 115 has a structure in which the piezoelectric layer 15A formed of a piezoelectric material and a low-permittivity layer 15C formed of an insulating low-permittivity material are laminated on the low-permittivity substrate layer 15B formed of an insulating low-permittivity material. The piezoelectric layer 15A and the low-permittivity layer 15C are horizontally adjacent to each other. Specifically, the piezoelectric layer 15A is disposed in a distal end portion of the actuator plate 115, and the low-permittivity layer 15C is disposed in the proximal end portion of the actuator plate 115. The discharge channels 12A formed in the actuator plate 115 are extended from the distal end surface of the actuator plate 115 to the position of the low-permittivity layer 15C, and the proximal ends of the discharge channels 12A are blocked by the low-permittivity layer 15C.

According to the inkjet head chip 141 including the above-mentioned actuator plate 115, the adjacent piezoelectric elements 11 are completely electrically separated from each other by the low-permittivity substrate layer 15B and the low-permittivity layer 15C, and the respective discharge channels 12A are completely electrically independent from each other, with the result that the respective discharge channels 12A are free from an effect of the electric field applied to other discharge channel 12A. Therefore, the respective discharge channels 12A are in a uniform electrical condition. Accordingly, the difference in ink discharge speed is hardly caused, further improving image quality of printing.

The inkjet head chip, the manufacturing method for an inkjet head chip, the inkjet head, and the inkjet recording apparatus according to the embodiments of the present invention have been described above, but the present invention is not limited to the embodiments described above and can be appropriately changed without departing from the gist thereof.

For example, in the embodiments described above, the description is given of the inkjet head chips 41 and 141 including the actuator plate 15 formed of the piezoelectric layer 15A and the low-permittivity substrate layer 15B, and an actuator plate 215 formed of the piezoelectric layer 15A, the low-permittivity substrate layer 15B, and the low-permittivity layer 15C, respectively. However, in the present invention, a layer other than the piezoelectric layer 15A, the low-permittivity substrate layer 15B, and the low-permittivity layer 15C may be formed on the actuator plate.

Figure 9:
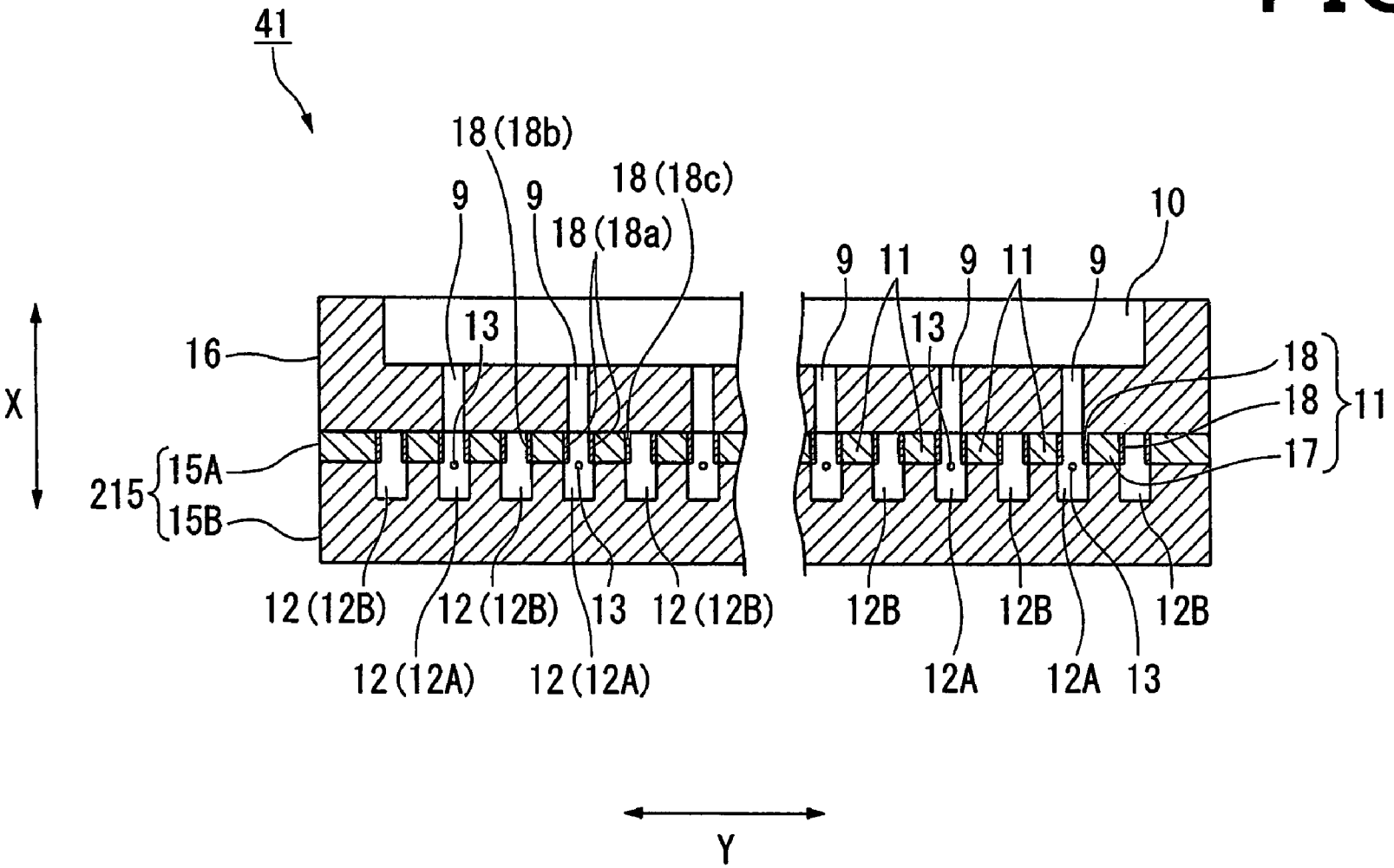
FIG. 9 is a cross-sectional view for illustrating an inkjet head chip according to another embodiment of the present invention.

Further, in the embodiments described above, the channel 12 has the depth equal to the thickness of the piezoelectric layer 15A, and the bottom surface of the channel 12 is flush with the interface between the piezoelectric layer 15A and the low-permittivity substrate layer 15B. However, in the present invention, the channel 12 may be formed deeper compared with the thickness of the piezoelectric layer 15A, and the bottom surface of the channel 12 may be formed at a position deeper than the interface. For example, as illustrated in FIG. 9, there can be used the actuator plate 215 in which the low-permittivity substrate layer 15B may be formed for about a half depth of the channel 12 and the piezoelectric layer 15A is formed for an amount of forming the drive electrodes 18. Accordingly, the center portion in the depth direction of the channel 12 can be the curved point to improve efficiency, to thereby reduce stray capacitance.

Further, in the third embodiment described above, the so-called shared wall type inkjet head chip 141 is provided with the actuator plate 215 including the piezoelectric layer 15A, the low-permittivity substrate layer 15B, and the low-permittivity layer 15C. However, in the present invention, the so-called independent channel type inkjet head chip 41 may be provided with the actuator plate 215 including the piezoelectric layer 15A, the low-permittivity substrate layer 15B, and the low-permittivity layer 15C.

Moreover, without departing from the gist of the present invention, the constitutional elements of the above-mentioned embodiments can be appropriately replaced by well-known constitutional elements, and the above-mentioned modifications may be appropriately combined with each other.

What is claimed is:

1. An inkjet head chip, comprising:

an ink chamber for containing ink;

a plurality of piezoelectric elements deformable by applying a voltage;

a plurality of channels partitioned with the plurality of piezoelectric elements and disposed parallel to each other;

a plurality of nozzle holes disposed in one end of the plurality of channels in a longitudinal direction for discharging an ink droplet toward a recording medium; and an actuator plate having the plurality of channels formed therein;

wherein the actuator plate has a laminated structure in which at least a piezoelectric layer and a low-permittivity substrate layer are laminated together, the piezoelectric layer being formed of a piezoelectric material forming the plurality of piezoelectric elements, the low-permittivity substrate layer being formed of an insulating low-permittivity material having a lower permittivity compared with the piezoelectric material, and the insulating low-permittivity material being exposed on bottom surfaces of the plurality of channels;

wherein the plurality of channels comprise a plurality of discharge channels that communicate with the respective nozzle holes and that communicate with the ink chamber through respective ink introduction holes, and a plurality of non-discharge channels that are arranged alternately in parallel with the discharge channels and in which supply of the ink from the ink chamber is interrupted;

wherein one end of each discharge channel extends to an end surface of the actuator plate in a state in which the insulating low-permittivity material is exposed on a bottom surface thereof and another end of each discharge channel does not extend to the end surface of the actuator plate; and wherein each non-discharge channel extends over at least an entire length of the actuator plate in a state in which the insulating low-permittivity material is exposed on a bottom surface thereof.

2. An inkjet head chip according to claim 1; wherein the actuator plate has a low-permittivity layer formed of the insulating low-permittivity material having the lower permittivity compared with the piezoelectric material, the low-permittivity layer being laminated on the low-permittivity substrate layer and being disposed adjacent to the piezoelectric layer; and wherein the another end of each discharge channel is blocked by the low-permittivity layer.

3. An inkjet head comprising the inkjet head chip according to claim 2.

4. An inkjet recording apparatus, comprising:

the inkjet head according to claim 3;

ink supply means for supplying ink to the ink chamber of an inkjet head chip; and recording medium transport means for transporting a recording medium so as to pass through a position opposed to the nozzle hole of the inkjet head chip.

5. An inkjet head comprising the inkjet head chip according to claim 1.

6. An inkjet recording apparatus, comprising:

the inkjet head according to claim 5;

ink supply means for supplying ink to the ink chamber of an inkjet head chip; and recording medium transport means for transporting a recording medium so as to pass through a position opposed to the nozzle hole of the inkjet head chip.

7. An inkjet head chip comprising:

an ink chamber for containing ink;

a plurality of piezoelectric elements deformable by applying a voltage;

a plurality of channels partitioned with the plurality of piezoelectric elements and disposed parallel to each other;

a plurality of nozzle holes disposed in one end of the plurality of channels in a longitudinal direction for discharging an ink droplet toward a recording medium; and an actuator plate having the plurality of channels formed therein;

wherein the actuator plate has a laminated structure in which at least a piezoelectric layer and a low-permittivity substrate layer are laminated together, the piezoelectric layer being formed of a piezoelectric material forming the plurality of piezoelectric elements, the low-permittivity substrate layer being formed of an insulating low-permittivity material having a lower permittivity compared with the piezoelectric material, and the insulating low-permittivity material being exposed on bottom surfaces of the plurality of channels; and wherein the plurality of channels comprise a plurality of discharge channels electrically isolated from one another and communicating with the respective nozzle holes and with the ink chamber through respective ink introduction holes, one end of each discharge channel extends to an end surface of the actuator plate in a state in which the insulating low-permittivity material is exposed on a bottom surface thereof, and another end of each discharge channel does not extend to the end surface of the actuator plate.

8. An inkjet head chip according to claim 7; wherein the actuator plate has a low-permittivity layer formed of the insulating low-permittivity material having the lower permittivity compared with the piezoelectric material, the low-permittivity layer being laminated on the low-permittivity substrate layer and being disposed adjacent to the piezoelectric layer; and wherein the another end of each discharge channel is blocked by the low-permittivity layer.

9. An inkjet head comprising the inkjet head chip according to claim 7.

10. An inkjet recording apparatus, comprising:

the inkjet head according to claim 9;

ink supply means for supplying ink to the ink chamber of an inkjet head chip; and recording medium transport means for transporting a recording medium so as to pass through a position opposed to the nozzle hole of the inkjet head chip.

11. A manufacturing method for an inkjet head chip, comprising the steps of:

providing an inkjet head chip comprising:

an ink chamber for containing ink;

a plurality of piezoelectric elements deformable by applying a voltage;

a plurality of channels partitioned with the plurality of piezoelectric elements and disposed parallel to each other; and a plurality of nozzle holes disposed in one end of the plurality of channels in a longitudinal direction for discharging an ink droplet toward a recording medium;

wherein the plurality of channels comprise a plurality of discharge channels that communicate with the respective nozzle holes and that communicate with the ink chamber through respective ink introduction holes, and a plurality of non-discharge channels that are arranged alternately in parallel with the discharge channels and in which supply of the ink from the ink chamber is interrupted;

wherein one end of each discharge channel extends to an end surface of the actuator plate in a state in which the insulating low-permittivity material is exposed on a bottom surface thereof and another end of each discharge channel does not extend to the end surface of the actuator plate; and wherein each non-discharge channel extends over at least an entire length of the actuator plate in a state in which the insulating low-permittivity material is exposed on a bottom surface thereof;

cutting, on a surface of a laminated plate formed by laminating at least a piezoelectric layer formed of a piezoelectric material forming the plurality of piezoelectric elements and a low-permittivity substrate layer formed of an insulating low-permittivity material having a lower permittivity compared with the piezoelectric material on the piezoelectric layer side, each of the plurality of channels having a depth at which the insulating low-permittivity material is exposed, to form an actuator plate having the plurality of channels formed therein;

forming electrodes on side surfaces of piezoelectric bodies disposed between adjacent channels to form the plurality of piezoelectric elements; and bonding an ink chamber plate including the ink chamber and ink introduction holes for introducing the ink contained in the ink chamber to the plurality of channels formed therein to the piezoelectric layer of the actuator plate, and bonding a nozzle plate including the nozzle holes formed therein to one end of the actuator plate in a channel longitudinal direction.

12. An inkjet head chip comprising:

an ink chamber plate having an ink chamber for containing ink;

an actuator plate comprising at least a piezoelectric layer and a low-permittivity substrate layer laminated together, the piezoelectric layer being formed of a piezoelectric material, and the low-permittivity substrate layer being formed of an insulating low-permittivity material having a lower permittivity than that of the piezoelectric material;

a plurality of discharge channels formed in the actuator plate and each communicating with the ink chamber and configured for discharging an ink droplet, one end of each discharge channel extending to an end surface of the actuator plate in a state in which the insulating low-permittivity material is exposed on a bottom surface thereof and another end of each discharge channel not extending to the end surface of the actuator plate;

a plurality of non-discharge channels arranged alternately in parallel with the discharge channels and in which supply of the ink from the ink chamber is interrupted, each non-discharge channel extending over at least an entire length of the actuator plate in a state in which the insulating low-permittivity material is exposed on a bottom surface thereof; and a plurality of piezoelectric elements formed of the piezoelectric material, the piezoelectric elements being disposed in the discharge and non-discharge channels and driven by a voltage signal for undergoing deformation to vary a volume in the discharge and non-discharge channels to thereby eject ink droplets from the discharge channels.

13. An inkjet head chip according to claim 12; further comprising a nozzle plate connected to an end surface of the actuator plate, the nozzle plate having a plurality of nozzle openings each disposed in communication only with respective ones of the discharge channels so that when the piezoelectric elements are driven by a voltage signal ink droplets are ejected from the discharge channels through the nozzle openings.

14. An inkjet head chip according to claim 12; wherein the ink chamber plate has a plurality of introduction holes via which the respective discharge channels communicate with the ink chamber so that ink from the ink chamber flows to the discharge channels; and wherein the non-discharge channels do not communicate with the ink chamber so that ink contained in the ink chamber does not flow into the non-discharge channels.

15. An inkjet head comprising the inkjet head chip according to claim 12.

16. An inkjet recording apparatus, comprising:

the inkjet head chip according to claim 12;

ink supply means for supplying ink to the ink chamber of the inkjet head chip; and recording medium transport means for transporting a recording medium so as to pass through a position opposed to the nozzle openings of the nozzle plate so that during ejection from the nozzle openings, the ink droplets are discharged toward the recording medium.

17. An inkjet head chip according to claim 12; wherein the actuator plate has a low-permittivity layer formed of the insulating low-permittivity material, the low-permittivity layer being laminated on the low-permittivity substrate layer and being disposed adjacent to the piezoelectric layer; and wherein the another end of each discharge channel is blocked by the low-permittivity layer.

* * * * *